US005603228A

United States Patent [19]

Barthold et al.

[11] Patent Number: 5,603,228

[45] Date of Patent: Feb. 18, 1997

[54] AUTOMATIC BLOW-OUT SYSTEM FOR SNOWMAKING MACHINE WATER HOSES

[76] Inventors: Scott Barthold, R.R. #2, Box 250, Lyme, N.H. 03768; Martin G. Midura, 340 N. Main St., W. Lebanon, N.H. 03784

[21] Appl. No.: 542,703

[22] Filed: Oct. 13, 1995

[51] Int. Cl.[6] ..... F28G 9/00

[52] U.S. Cl. ..... 62/303; 137/240

[58] Field of Search ..... 62/347, 303; 239/2.2; 137/240

[56] References Cited

U.S. PATENT DOCUMENTS

| | | | |
|---|---|---|---|
| 3,273,585 | 9/1966 | Patch | 137/240 |
| 3,908,903 | 9/1975 | Burns, Jr. | 239/2.2 |
| 3,947,228 | 3/1976 | Stenlund | 137/240 |
| 3,969,908 | 7/1976 | Lawless et al. | 62/347 |
| 4,554,942 | 11/1985 | Williams et al. | 137/240 |
| 4,916,911 | 4/1990 | Duryea et al. | 62/347 |
| 5,526,841 | 6/1996 | Detsch et al. | 137/240 |
| 5,531,240 | 7/1996 | Kelada | 137/240 |

*Primary Examiner*—William E. Tapolcai

*Attorney, Agent, or Firm*—Sughrue, Mion, Zinn, Macpeak & Seas

[57] ABSTRACT

A cross connect hose is coupled between an outlet of an air hydrant at a first end or a blow-out port of a modified three way ball valve, and an outlet of a water hydrant, at a second opposite hose end. A T-fitting mounts a check valve assembly integrated to the second end of the cross connect hose. The check valve assembly includes a spring biased valve disk which seats against an annular check valve body to close off an axial bore leading from the cross connect hose to a counter bore including a series of radial ports opening to the interior of the T-fitting, thereby subjecting the opposite face of the disk valve to the pressure of the water passing from the water hydrant to a downstream snowgun via a water hose. The bias of the coil spring plus the water pressure normally maintains the check valve closed. During water shut-down, air pressure from the compressed air line opens the valve disk against the bias of the coil spring causing compressed air to purge the water hose of water in the direction of the snowgun. Dual three way ball valves at respective opposite ends of a water hose coupled to a fan type snow making machine form primary elements of a modified automatic water hose blow out system.

7 Claims, 4 Drawing Sheets

FIG.1
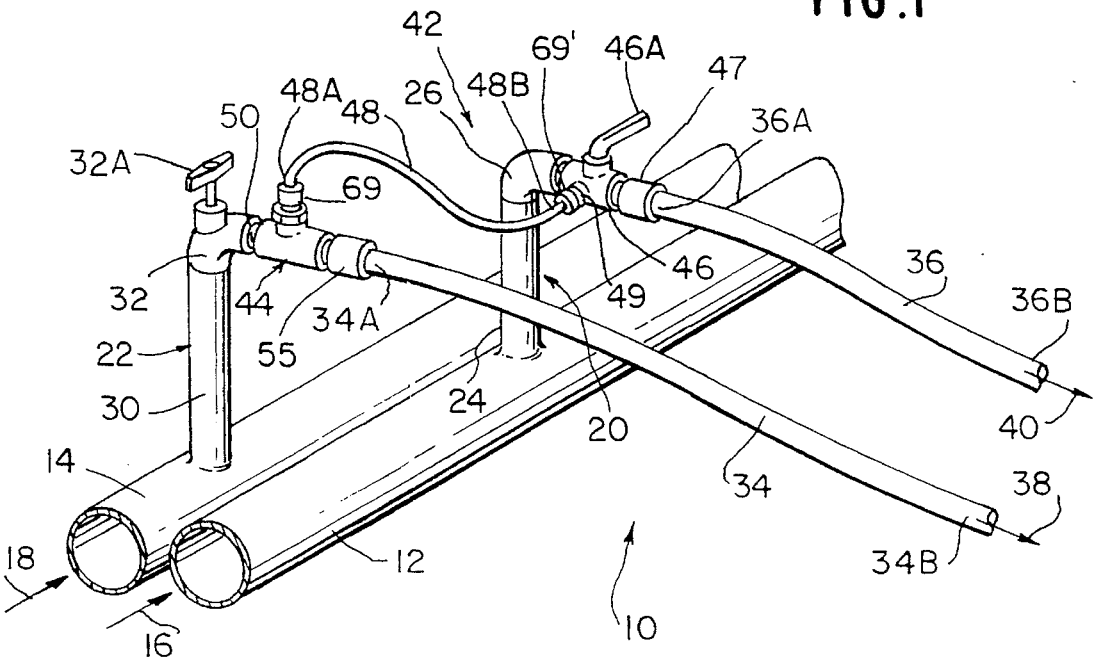
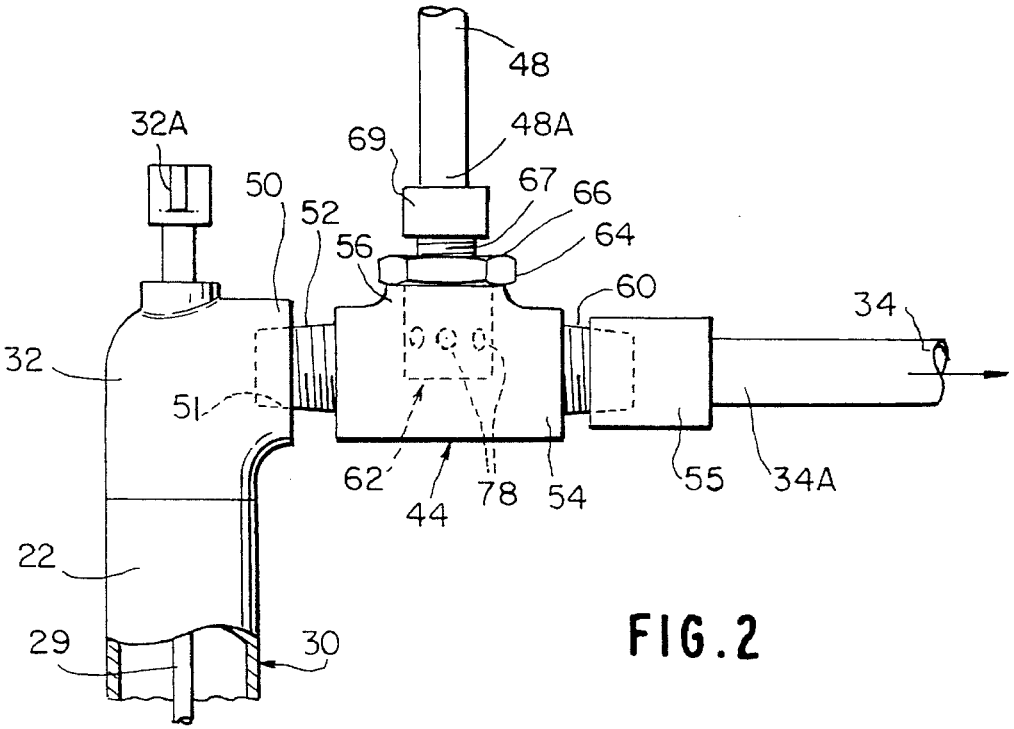
FIG.2

AUTOMATIC BLOW-OUT SYSTEM FOR SNOWMAKING MACHINE WATER HOSES

FIELD OF THE INVENTION

This invention relates to snowmaking systems, and more particularly to an automatic blow-out system for blowing out water hoses leading from a water manifold to a snowgun remote from the water manifold.

BACKGROUND OF THE INVENTION

In compressed air/water snowmaking systems, two separate hoses are connected to each snowmaking gun and opening to the snowgun nozzle. One of the hoses contains water and the other contains compressed air. Typically, metal water and compressed air manifold pipes extend parallel to each other in the direction of the ski slope or trail, with those pipes either being exposed or beneath the ground. Typically, at longitudinally spaced positions along the respective pipes, water hydrants and air hydrants extend upwardly, such hydrants being typically of cast metal and being welded to the pipes with lower inlet ends opening to the interior of the water and compressed air manifold pipes. Such water and air hydrants include manual shutoff valves for controlling the flow between the inlet of the water and air hydrants and typically right angle outlets downstream of the shutoff valves. Flexible water hoses and air hoses are threaded to the hydrant outlets at one end and are connected to respective water and air inlets at the snowgun. When the snowgun is shut down, the water in the water hose must be drained to prevent freezing. In the past, this is typically done by manually disconnecting the end of the water hose at the water hydrant outlet and turning on the compressed air to pressurize the snowgun and to blow any water within the snow gun and the water hose backwards through the hose, which then exits at the hose end previously connected to the water hydrant outlet.

In the past, automatic snowmaking operations have primarily implemented tower mounted snowguns where the hose is mounted to always enable the water hose to drain by gravity. Automatic operations using land or sled mounted snowguns have required expensive multi-directional air valves to be installed in order to achieve the required blow-out of water hoses.

It is therefore a primary object of the present invention to provide a simple, automatic blow-out system for snow making guns to ensure automatically, upon shutoff of the water supply to a particular gun, the blow-out of the water retained within the water hose in the direction of the snowmaking nozzle of the snowgun, and in which the necessity for disconnecting the water hose at the water hydrant outlet is eliminated.

It is a further object of the present invention to provide an automatic blow-out system for snowmaking guns which utilizes a simple spring-loaded check valve connection between the water and air piping to the individual guns and restriction means within the air piping to accomplish automatic water hose blow-out through the snowmaking nozzle without power or complicated valving.

SUMMARY OF THE INVENTION

The present invention is directed to an improvement within a snowmaking system comprised of a first manifold pipe for carrying compressed air under pressure adapted to be coupled at one end to a source of compressed air and a second manifold pipe for carrying water under pressure and adapted to be coupled at one end to a source of water under pressure. At least one air hydrant is connected to said air manifold pipe remote from said source of compressed air and includes a shut-off valve opening to an air hydrant outlet. An air hose is coupled at one end to said air hydrant outlet having a second end adapted to be coupled to an air inlet of a snowgun. At least one water hydrant is connected to said water manifold pipe remote from said source of water and includes a shut-off valve opening to a water hydrant outlet. A water hose is coupled at one end to said water hydrant outlet and has a second end adapted to be connected to a water inlet of the snowgun. The improvement resides in a cross conduit means connecting the outlet of the air hydrant to the outlet of the water hydrant downstream of at least the shut-off valve of the water hydrant. A check valve means within said cross conduit means between said hydrants prevents flow of water into the air hose at any time and permits flow of compressed air automatically through the water hose when the shut-off valve of the water hydrant is closed for blowing any water within the water hose through the snowmaking gun nozzle. A restriction within the air hydrant or just downstream thereof ensures sufficient air pressure within the cross conduit to blow out the water hose after snowgun shut down.

Preferably, a check valve body is connected to the end of the cross conduit means proximate to the water hydrant outlet. Further, preferably T-fittings having in-line ends are interposed between the hydrant outlets and the respective hoses with a right angle projection of the T-fitting connected to a respective end of the cross conduit means. The check valve assembly consists of a cylindrical check valve body having an axial bore and a counter bore within one end and a lock ring at said one end. The lock ring carries internally a coil spring interposed between an axial end of the lock ring and one face of a valve disk having its opposite face in contact with the check valve body. The valve disk has a diameter in excess of the axial bore but less than the diameter of the counter bore. Preferably, the check valve body on an axial face between the check valve body bore and counter bore carries an O-ring seal to ensure valve disk sealing of the axial bore from the counter bore. The coil spring has a spring constant providing a valve disk closure force less than the force exerted by the compressed air from the cross conduit means, such that water under pressure, normally passing from the water manifold through the water hydrant and acting on the same face of the valve disk as the coil spring, provides with the bias of the coil spring a force in excess of the compressed air to maintain the check valve disk sealed against the check valve body at the axial bore, thereby preventing water from passing through the cross conduit means into the air hose, but permitting upon closure of the shut-off valve in the water hydrant, compressed air to pass through the check valve for purging water from the water hose in the direction of the snowgun.

Preferably a T-shaped air hydrant valve is interposed between the air hydrant and the air hose. The valve is a ball-type three-way valve including a side port and inlet and outlet ports. The rotatable spherical valve member internally is provided with a through bore and a slant cutaway on the periphery spaced from the through bore. The three-way air hydrant valve by rotation of the ball valve member selectively through three positions closes off flow through the spherical valve cavity of the valve body or permits flow through with the valve member bore aligned with the inlet and outlet ports of the valve body or connects the source of air through the slant cutout, acting as an airflow restriction means, to the blow-out side port which connects directly to one end of the cross connect hose leading to the water hose downstream of the water hydrant.

In a further embodiment of the invention when employed for a fan-type snowmaking machine which includes an onboard air compressor for supplying compressed air to a nucleator line in the area of discharge of water from a water hose connected to the water pipeline via a water hydrant, the system employs automatic three-way ball valves with a blow-out port at opposite ends of the water hose, one three-way ball valve mounted to the fan-type snowmaking machine, and the other interposed between the end of the hose and the water hydrant. The blow-out port of the three-way ball valve at the fan-type snowmaking machine is connected to the onboard compressor. The automatic three-way ball valve coupled between the end of the water hose and the water hydrant has its blow-out port open to the atmosphere to ensure blow-out of all water from the water hose during automatic system operation, with the rotatable ball valve member positioned such that the slant cutout on the periphery of the spherical valve member communicates the blow-out port to the outlet port of the automatic ball valve body coupled directly to the water hose.

In both embodiments of the invention, to enhance air passage through the cross conduit of the first embodiment and to enhance air passage through the water hose in the second embodiment, the valve body carrying the spherical ball valve member in a spherical cavity of the valve body is provided with three ports, and inlet, an outlet and a blow-out port with the inlet and outlet in line. In a valve closed valve member position at 0°, the ball rests against an upstream circular seat in order to shut off flow to the snowmaking gun or fan-type snowmaking machine. In the open position (90°), the ball allows air to pass directly through the valve via the through hole, typical in standard two-way ball valves. In the blow-out position at 180°, the slanted face milled in the ball valve periphery allows air from the inlet to escape into the ball valve cavity where it exits through the blow-out port in the first embodiment, and in the second embodiment permits bypass air from the onboard compressor of the fan-type snowmaking machine to pass into the bypass port and through the inlet port of the modified three-way ball valve to blow out residue water in the water hose via the blow-out port of the ball valve coupled to the end of the hose remote from the snowmaking machine, with the second ball valve set to effect via the slanted face milled in its ball valve member a passage from the end of the water hose to the blow-out port thereof, open to the atmosphere.

BRIEF DESCRIPTION OF THE DRAWINGS

FIG. 1 is a perspective view of a portion of an air/water snowmaking system illustrating side-by-side water and compressed air manifolds, a respective pair of water and air hydrants and connections to respective water and air hoses leading to a snowgun and the automatic blow-out system for the water hose forming a preferred embodiment of the invention.

FIG. 2 is an enlarged elevational view of a portion of the water hydrant and its connection to the water hose and to a cross connect hose forming a part of the automatic blow-out system of FIG. 1.

DESCRIPTION OF THE PREFERRED EMBODIMENT

Figure 3:
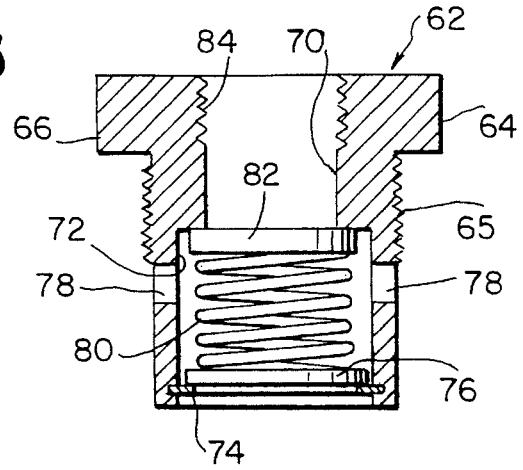
FIG. 3 is a sectional view of the check valve assembly forming a principal component of the automatic water hose blow-out system of FIGS. 1 and 2.
Figure 4:
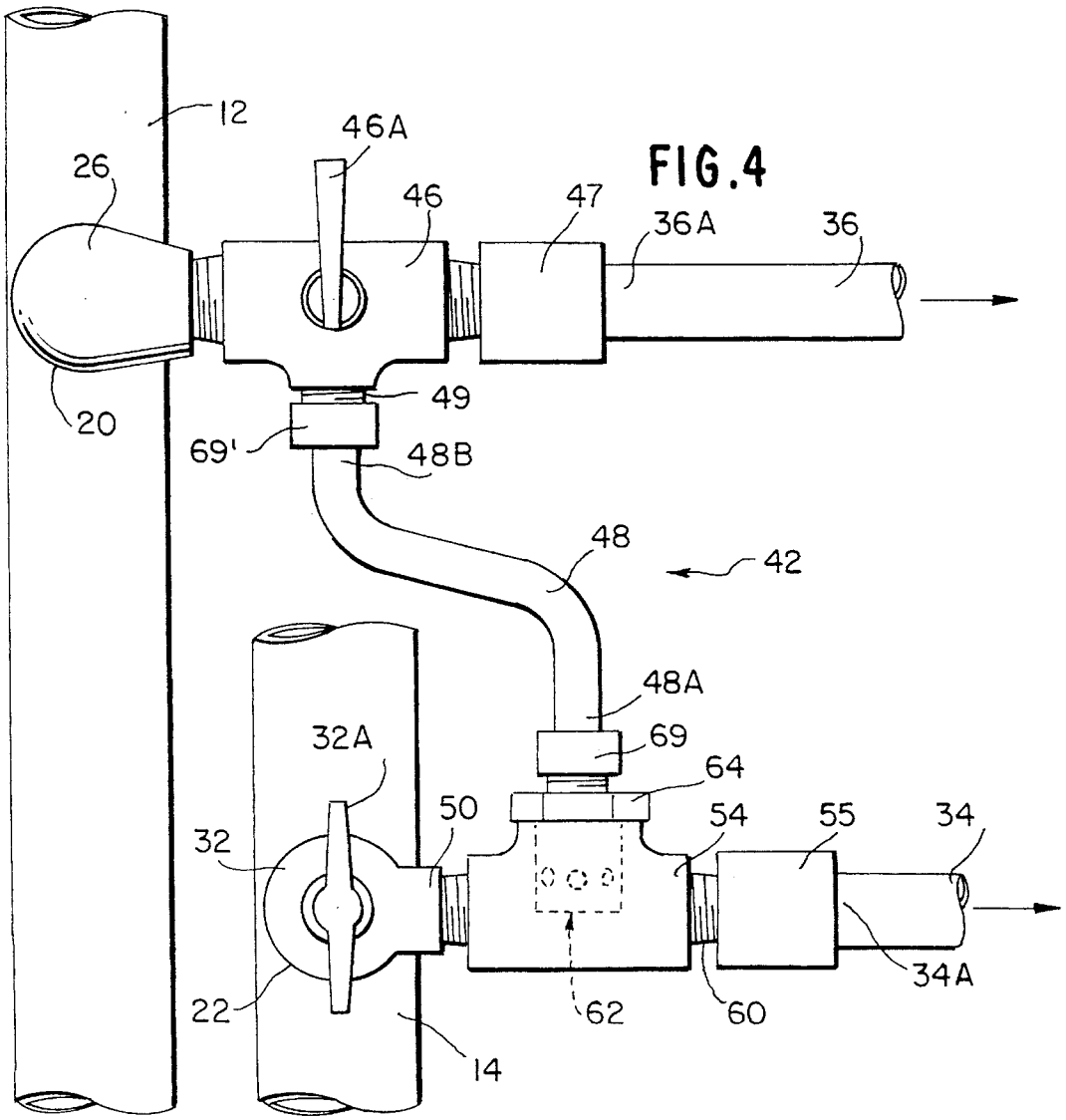
FIG. 4 is an enlarged top plan view of the automatic blow-out system for the water hose 34 of FIG. 1.

Referring to the drawings, FIG. 1 illustrates certain basic components of a snowmaking system indicated generally at 10. Snowmaking systems in general require a source of compressed air and a source of water under pressure, both of which must be fed over the terrain to be covered with snow, usually an upwardly inclined slope of a hill, mountain or the like. The components of the compressed air/water snowmaking system 10 pertaining to the invention include a compressed air manifold pipe 12 formed of metal or the like and adapted to carry a flow of compressed air from a source indicated generally by the headed arrow 16. Extending parallel to the compressed air manifold pipe 12 is a second water manifold pipe 14, which carries water under pressure from a source indicated schematically at 18. At suitably spaced positions, such as 100 feet or so, connections must be made to respective snowguns (not shown), which may be movable or fixed, but which are normally some distance from the compressed air and water manifold pipes 12, 14. In order to make the connections, typically the compressed air pipe 12 is provided with vertically upright air hydrants, indicated generally at 20, while adjacent thereto and at nearly the same longitudinally spaced positions are a series of water hydrants, indicated generally at 22. The air hydrant consists of a vertical riser 24 of one to several feet, terminating in a right angle elbow 26 coupled to an air hydrant modified three-way ball valve 46. A handle for operating the air hydrant shut-off valve 46 is illustrated at 46A. Alternatively, such valves both for the air hydrants and the water hydrants may be electrically, pneumatically or hydraulically operated via a computer operated control system.

To the rear of the compressed air manifold pipe 12, the water hydrant 22 is similarly composed of a vertical riser or pipe 30 opening interiorly to the water manifold pipe 14 and terminating at the top in an elbow or cast fitting 32. A handle at the top of the water hydrant conventionally connects to a shaft which runs through a seat packing gland, through the middle of the riser pipe, operates a movable valve member which seats at the base of the hydrant. This shaft is controlled by a manually operated valve actuator or handle 33A. Conventionally, one end 34A of a water hose 34 is coupled by way of a hose coupling fitting 67 directly to a discharge coupling of the T-fitting 44 at the outlet of water hydrant 22, while similarly, one end 36A of air hose 36 is sealably coupled via hose coupling 50 to a discharge coupling 47 of air hydrant valve 46.

In the illustrated system 10, FIGS. 1–7, the invention resides in an automatic water hose blow-out system 42 for each snowgun coupled to the manifold pipes 12, 14, supplying respectively the compressed air and water under pressure. This automatic water hose blow-out system 42 comprises standard plumbing T-fitting 44 connected to the water hydrant at its outlet, and a connection to the modified three-way ball valve blow-out port 49. The air hydrant blow-out port is at 49, FIG. 1, while that for the water hydrant T-fitting 44 is at 50. The standard plumbing T-fitting 44 connects the inlet 34A of the water hose 34 to the hose coupling outlet 55. The modified three-way valve 46 connects the inlet end 36A of the air hose 36 to the outlet of air hydrant 20. A cross connect conduit or hose 48 forms another principal element of the automatic water hose blow-out system, along with a check valve assembly indicated generally at 64, FIG. 2.

Referring to FIG. 2, the upper end of the water hydrant 22 at elbow 32 terminates in water hydrant outlet 50 having an internal tapped thread at 51 which receives an externally threaded, axial end 52 of T-fitting 44. The in-line, opposite axial end of the T-fitting 44 at 54 is provided with an externally threaded portion 60 which receives an internally threaded annular fitting 55 on the inlet end 34A of the water hose. At the longitudinal center of the T-fitting 44, a right angle, outwardly projecting section 56 of the T-fitting is internally tapped, within which mounts the check valve assembly 62. That assembly includes an annular check valve body 64 which may be made of cast or machined metal, having an externally tapped thread at 65 on a reduced diameter portion of the check valve body emanating from a large diameter collar 66. The collar 66 has a polygonal external configuration to permit wrench tightening of the check valve body 64 onto the projection 56 of the T-fitting 44.

As seen from FIGS. 2 and 3, the check valve body 64 is provided with an axial bore 70 which is counterbored at 72. The check valve body 64 is closed off by an annular lock ring 74, having an internal bore 73 corresponding to that of counterbore 72. Interposed between the lock ring 74 and the check valve body is a coil spring 80, one end of which abuts an annular metal valve disk 82 of a diameter somewhat less than that of counterbore 72 of the check valve body but larger than the diameter of the bore 70. The annular valve disk acts as a movable valve member for closing off the communication between bore 70 and counterbore 72. A portion of the bore 70 of the check valve body at the collar 66 is provided with an internal thread 84 matching the external thread 67 of the metal fitting 69 at end 48A of the cross connect conduit or hose 48. A series of circumferentially spaced small diameter holes 78 are drilled radially within the sidewall of the check valve body 64 at counterbore 72 so as to permit the escape of compressed air into the interior of T-fitting 44 in the absence of water pressure beneath the valve disk 82. Valve disk 82 abuts an O-ring 79 within the recess created by counterbore 72. The coil spring 80 provides a biasing force when compressed as shown between the closed valve disk 82 and the bottom wall 76 of the lock spring, which is incapable of maintaining the disk valve 82 in valve closed position absent the pressure of the water from source 18 acting jointly on the bottom face of the valve disk 82, with the shut-off valve 33A of the water hydrant 22 open. Its spring constant is correlated to the desired water pressure flowing through the T-fitting 44 from water manifold 14 to the snowgun as indicated by arrow 38, FIG. 1.

The opposite end 48B of the cross connect hose or conduit 48 is connected via a threaded metal annular fitting 69 identical to that at 65 directly to an internally tapped bore or to a threaded nipple attached to the blow-out port 49 of the air hydrant modified three-way valve 46. The outlet of the modified air hydrant valve 46 is connected to the hose coupling 47 which attaches to the air hose end 36A. With the opposite, outboard ends 34B and 36B of the water hose and air hose 34, 36, respectively, connected to appropriate inlets of the snowgun, the blow-out system 42 is ready for operation.

The automatic water hose blow-out system 42 of this invention consists therefore of a short length hose or cross conduit 48 running from the blow-out port 49 of the air hydrant valve 46 to the T-fitting 44 at the downstream side of the water hydrant shut-off valve 33. Preferably, the spring loaded check valve assembly 62 is installed in the water hydrant piping by way of the standard plumbing T-fitting 44 to permit compressed air to flow into the water hose 34 when the air pressure constantly available at the air hydrant exceeds the water pressure plus the bias of coil spring 80 by a set amount. The absence of air pressure does not permit water to flow into the air hose 36 since the valve disk 82 seats on an O-ring 79 interposed in the axial end face of the check valve body 64 between the axial bore 70 and counterbore 72 of that member.

Figure 7:
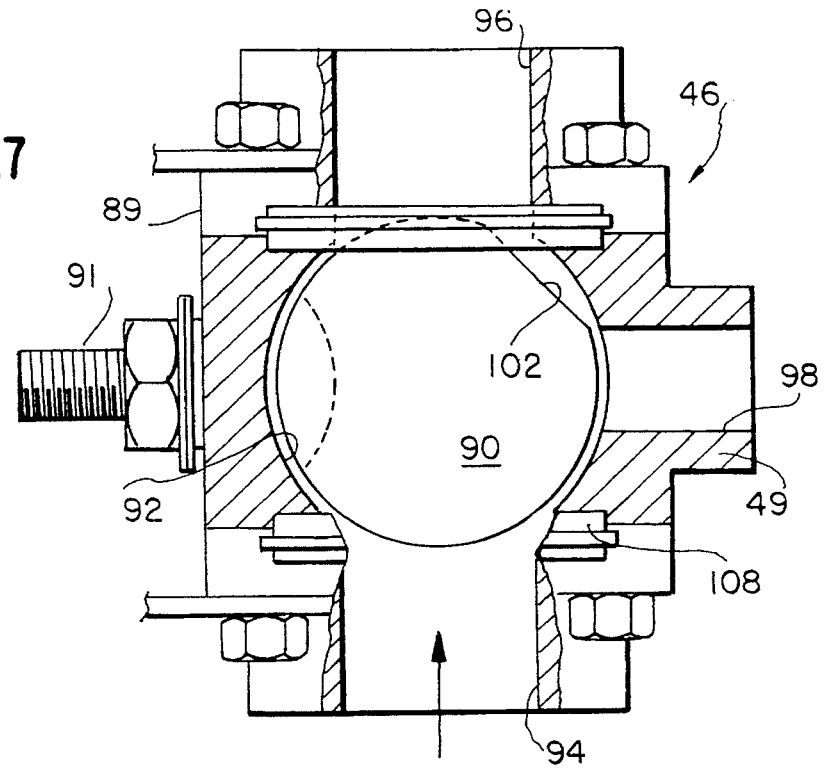
FIG. 7 is a similar sectional view to that of FIGS. 5 and 6, with the ball valve rotated 90° from that of FIG. 6 and with the ball valve member resting against the upstream seat and shutting off airflow through the modified three-way valve.

In operation with the modified three-way ball valve 46 in the closed seated position of FIG. 7, the water hydrant shut-off or control valve 33 is opened first by manual or automatic operation of handle 33A and water flows through the water hose via T-fitting 44 and spills from the snowgun (not shown). At this time, the air three-way ball valve 46 of air hydrant 20 is rotated by manual or automatic operation of the handle or valve operator 28A coupled to activating shaft 91 to place the ball valve member 90, FIG. 5, in a position to allow compressed air to flow directly through the valve body 89 and through passage 66 of the rotatable ball valve member 90 from inlet port 94 to outlet port 96. Compressed air mixes with the water stream in the nozzle of the snowgun, thereby back pressuring the water hose 34. The precise pressure difference between the water in the water hose and the air in the air hose depends on the type of snowgun, the ambient temperature, the type of snow desired to be made. In the case of some air/water snowguns at marginal snowmaking temperatures, the optimal water pressure is less than the air pressure. The spring rating on the check valve, that is the bias of the spring must compensate for this differential to prevent the compressed air from entering the water hose.

When the snowmaking gun (not shown) is shut down, water pressure drops to very low levels. Some guns exhibit considerable back pressure of air, so water pressure at closed position remains close to air pressure, while the air is at a higher pressure. At this point, the air modified three-way valve 46 is rotated to the position shown in FIG. 6 to direct most or all of the compressed air into the blow-out port 49, through the cross-connect hose 48 and into the water hose by displacing the valve disk 82 in the direction of the coil spring 80 against the pressure of the coil spring which is incapable of itself in holding the valve disk closed on its seat, that is against the O-ring seal 79, thereby automatically blowing out all moisture within the water hose from its connection at T-fitting 44 through the passages within the snow gun and out the nozzle aperture. When hose blow-out is complete, the air shut-off or control valve 28 is rotated momentarily through the open position to clear any water built-up in the air hose, and then to the closed position where the upstream seat prevents any additional flow of air to the blow-out port 94 or outlet port 96.

The incorporation of the modified three-way ball valve 46 between the air hydrant and the air hose with the blow-out side port 49 connected to the cross-connect hose 48 guarantees sufficient airflow through the water hose to blow out the same via the flat milled into the spherical ball valve member, which forms a restriction to airflow from the air piping or manifold 12. With some air/water guns, the air orifice in the gun is so large that there is insufficient back pressure to force adequate volumes of air through the check valve 62 and back through the water hose to the snowgun. The result is that the water hose is only partially blown out and freezing of that residue water is detrimental to proper operation of the snowmaking system. The three-way valve solves this problem by forcing air into the cross hose or cross conduit.

As may be appreciated from FIG. 7, with the rotatable ball valve member seating against the upstream seat 108, the valve is in a condition to prevent the air from leaking. With the rotatable ball valve member 90 rotated 90° to the open position, air may pass straight through the valve via the through passage 106, FIG. 5, as within a standard two-way ball valve. When the ball is turned an additional 90° (180° from closed position, FIG. 7, to that of FIG. 6), air passes into the ball valve cavity 92 across the flat or flat shaped face 102, which is machined in the periphery of the ball valve member 90, with the air passing through a narrow passage or restriction into bore 98 of the blow-out port 49. Blow-out port 49 in the valve body allows the air to escape into the blow-out hose which results in complete blowing out of the water hose downstream of the check valve 62. Depending upon the exact position of the rotatable ball valve member 90, the air hose 36 to the gun can be completely blocked off during the blow-out, or partially blocked off, to allow some compressed air flow that prevents water at the snowgun from bleeding back into the air hose. Preferably, the modified three-way ball valve 46 is such that the ball valve member 90 may be rotated an additional 180° back to the closed position, FIG. 7, from that of FIG. 6. In doing so, it briefly passes through the valve open position, FIG. 5, ensuring that the air hose has not accumulated any moisture during the blow-out process.

Figure 8:
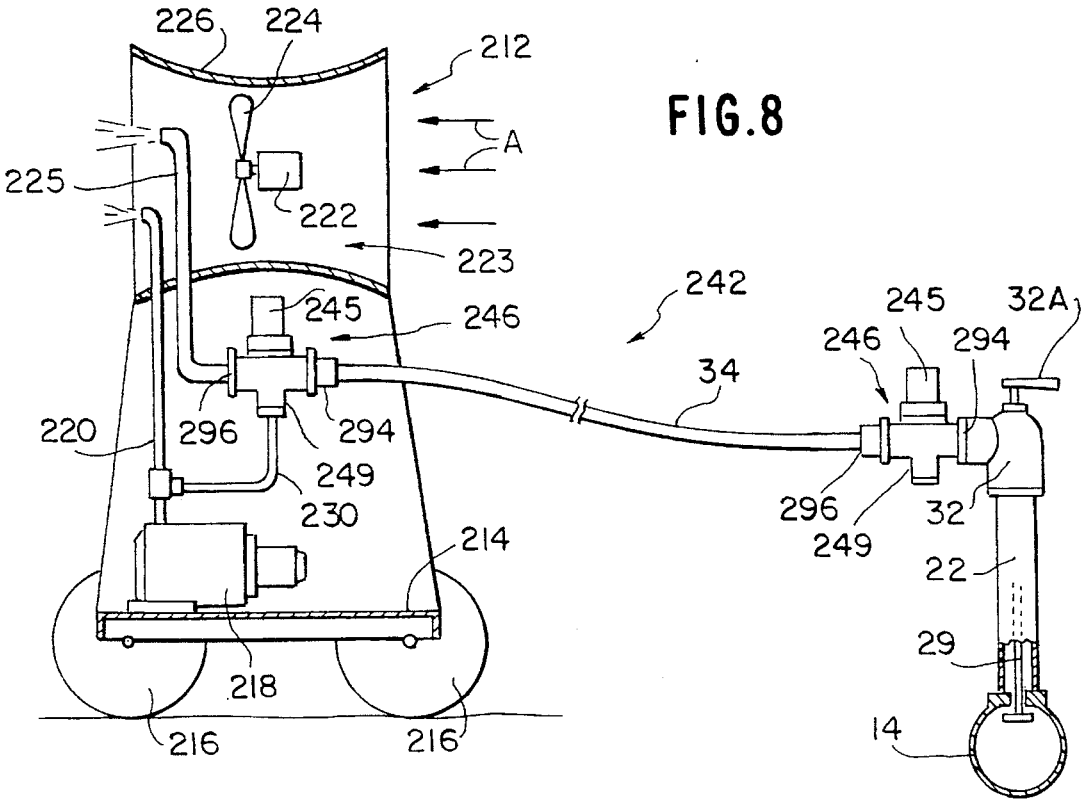
FIG. 8 is a schematic view of an automatic blow-out system for a fan-type snowmaking machine forming a second embodiment of the invention and utilizing an onboard air compressor within the fan-type snowmaking machine as a source of compressed air.

Referring next to FIG. 8, there is illustrated a further automatic water hose blow-out system forming a second embodiment of the invention, particularly applicable to fan-type snowmaking machines, such as that illustrated at 212, FIG. 8. Such machines use an air stream indicated generally at 223 in which an electrical motor 222 drives a fan blade 224 mounted coaxially within an annular shroud 226 at the top of the machine base or chassis 214. The chassis may be mounted on wheels 216, or on sled rails or the like. The chassis 214 additionally mounts an onboard air compressor 218 which has an outlet pipe, conduit, or hose 220 for feeding air into the water droplet/airflow A, passing through the interior of shroud 226. Unlike snowguns, there is no premixture of water and air ejected at high pressure through a nozzle, although there is the necessity for water entrainment in an air stream emanating from water pipeline 14 in the manner of the first embodiment.

Like elements in the snowmaking system 210 to that of the first embodiment, FIGS. 1–7, bear like numerals. The water pipe or pipeline 14 bears an upright hydrant 20 terminating in an elbow 26 through which passes a valve operating stem 29 controlled by a water valve control handle 28A. Similar to the system 10 of the first embodiment, a water hose 34 is connected between the water hydrant 20 and the fan-type snowmaking machine 212. However, in this system, the automatic water hose blow-out system 242 of the invention employs as principal component, two automatic modified three-way ball valves indicated generally at 246 which are coupled directly to opposite ends of the water hose, with one of the ball valves coupled between the upstream end of the water hose and the hydrant 20 via elbow 26, while the other of the two automatic modified three-way ball valves is mounted to the opposite end of the water hose. The modified three-way ball valves 246 are essentially identical to the modified three-way valve 46 in the first embodiment. As such, the three-way valve 246 at the fan-type snowmaking machine 212 has an inlet port 294, an outlet port 296 and a blow-out side port 249. The blow-out side port 249 on machine 212 is connected to the nucleator conduit or hose 220 via a split or bypass line 230 which bleeds some of the compressed air emanating from the onboard air compressor 218, and function in this automatic water hose blow-out system 242 to force the residue water from the water hose after termination of snowmaking without disconnecting the hose from the water pipeline 14 via water hydrant 20, with the automatic modified three-way ball valve 246 coupled to the hydrant via elbow 26 to ensure shut-off of the water hose 34 from the water within the pipe 14. Under normal conditions, the modified three-way ball valve 246 at the connection of water pipeline to water hose 34 is such that its ball valve member is in the position shown in FIG. 5, with its through passage in line with the inlet and outlet ports 294 and 296, respectively. With respect to the modified three-way ball valve 246 at the opposite end of water hose 34, on machine 212 remote from the water pipeline, the rotatable ball valve member (not shown) of that valve 246 is in a position corresponding to that of FIG. 5 of the first embodiment, such that the through passage thereof is aligned with the inlet 294 and the outlet 296 of that valve. As such, the blow-out side ports 249 of both modified three-way ball valves 246 are closed. Compressed air from the onboard compressor cannot flow into the system, nor can water be discharged through the blow-out side port 249 of the modified three-way ball valve 246 proximate to water hydrant 20.

Figure 5:
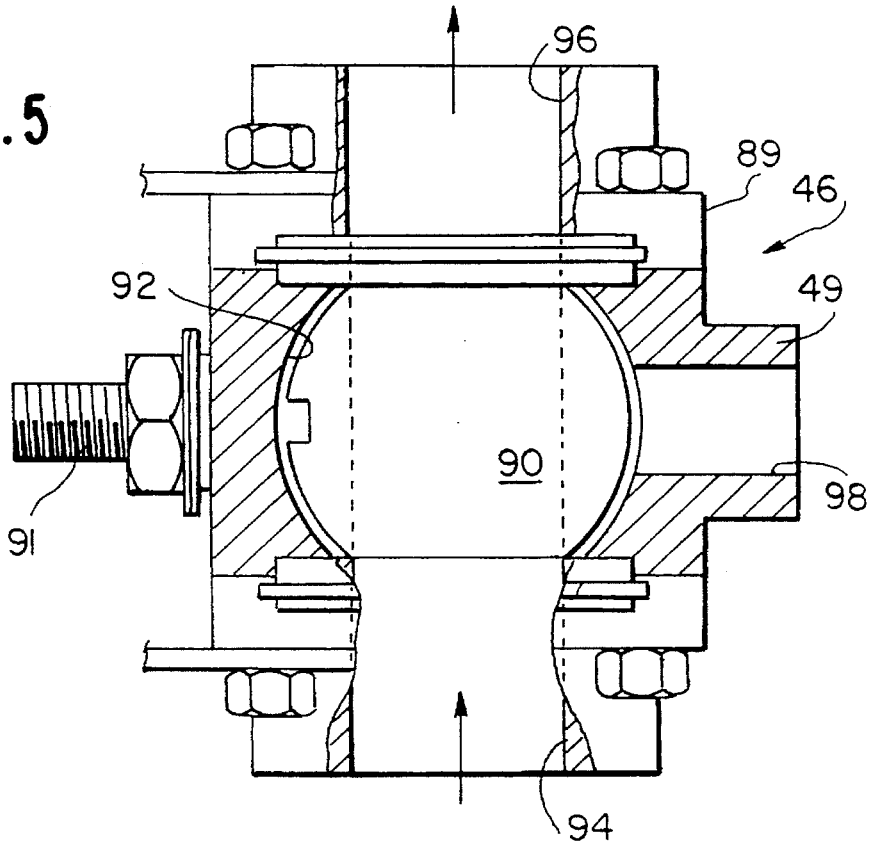
FIG. 5 is a schematic sectional view of the modified three-way ball valve 46, with the rotatable ball valve member in a position where its through passage is in alignment with the inlet and outlet ports of the valve body.
Figure 6:
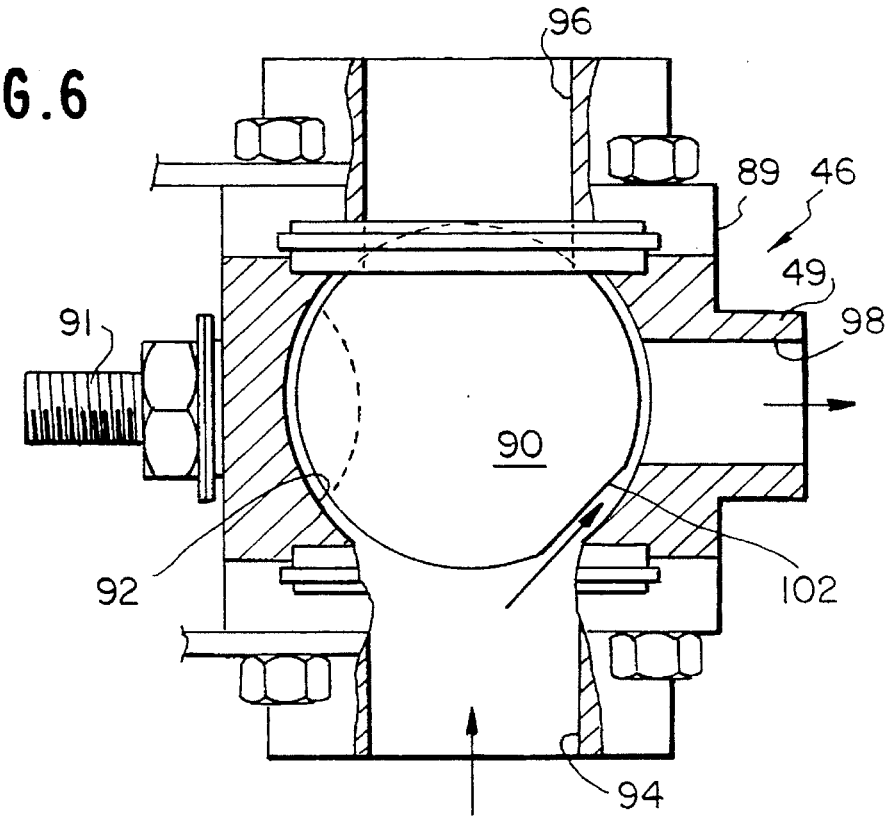
FIG. 6 is a similar sectional view to that of FIG. 5, with the rotatable ball valve member rotated 180° to a position permitting blow-out by connection of the air inlet port to the blow port via the flat shaved face of the periphery of the ball valve member.

Under blow-out operations, without disconnecting the water hose at either end and with the fan 223 inoperable, preferably by computer operated control system or other electrically operated control system, the rotatable ball valve members of the respective three-way ball valves 246 are rotated 90° from the position corresponding to that of FIG. 5 in the first embodiment to that corresponding to FIG. 6, such that the flat 102 of each ball valve member forms a passageway with a spherical valve cavity 92 between the blow-out port 249 of the modified three-way ball valve 246, with the outlet port 296 sealed off. This permits some compressed air from the onboard compressor 218 to pass through the nucleator line or conduit 220, the bypass hose 230, the blow-out side port 249 and the open port 294 coupled to the water hose 34, thereby driving the water from the interior of the water hose and through the modified three-way ball valve 246 adjacent the water hydrant 20 via a passage from outlet port 296 of that three-way valve for discharge to the atmosphere via its blow-out side port 249. Under this condition, the water hydrant 20 is closed off from water hose 34 and the end of the water hose remote from the water hydrant is closed off to the water distribution ring or manifold 225 associated with the fan 223 downstream of the fan blades, at the downstream end of shroud 226.

Preferably, the modified three-way ball valves forming components of systems 42 and 242 are electrically, pneumatically or hydraulically controlled and energized or operated remotely via a computer or the like with drive motors 245 receiving appropriate signals, for instance capable of ensuring rotation of the rotatable ball valve member through an initial 180° in one direction and back through 180° in the opposite direction to effect the desired three-way action of the valves 46, 246.

The automatic water hose blow-out systems 42 and 242 of this invention have a number of advantages. First, the ability to blow out the water hose leading to snowguns or fan snow making machines without the necessity to disconnect any hose fittings speeds up the process and promotes the safety for the snowgun operators while allowing instantaneous re-initiation of the snowmaking process.

The automatic water hose blow-out systems provide the ability to remotely blow out such water hose, using a simple mechanical, high air pressure, fail-safe mechanism. This allows automated guns to operate via remote control when using snowguns that are not tower mounted and that are incapable of draining themselves through gravity.

Thirdly, the automatic water hose blow-out systems provide the ability to blow out hose sections in air/water snowmaking systems after a power outage. Typically, a valve at the top or bottom of the mountain is opened to drain the water piping. As the water pressure at each hydrant location drops below the air pressure remaining in the lines, the hose sections leading to each gun that is operating is blown out, thereby preventing the water from freezing in the hose and allowing the system to be started up easily once power is restored.

It should be noted that while each control device of the automatic blow-out systems 42, 242 is a relatively simple spring loaded check valve with an O-ring seal, the O-ring 78 must be strategically placed to prevent the compressed air, which passes between the O-ring and the facing surface of the valve disk, from blowing the O-ring out of its groove. In addition, the check valve assembly 62 needs to be constructed in a manner that permits it to be immersed in water flow of the snowgun since some of its components are within the water flow emanating from the water hydrant and flowing through the water hose past the check valve assembly 62.

While the invention has been described with respect to preferred embodiments, it should be understood that changes may be made without departing from the spirit from the invention. Further, while the embodiments of the invention are described in detail, such is for the purpose of illustration, not limitation.

I claim:

1. In a snowmaking system comprising:

a snow gun, a first manifold pipe for carrying compressed air under pressure and being adapted to be coupled at one end to a source of compressed air, a second manifold pipe for carrying water under pressure and being adapted to be coupled at one end to a source of water under pressure, at least one air hydrant connected to said air manifold pipe remote from said source of compressed air and including a shut-off valve opening to an air hydrant outlet, an air hose coupled at one end to said air hydrant outlet and having a second end adapted to be coupled to an air inlet of a snowgun, at least one water hydrant connected to said water manifold pipe remote from said source of water and including a shut-off valve opening to a hydrant outlet, a water hose coupled at one end to said hydrant outlet and having a second end adapted to be connected to a water inlet of said snowgun, the improvement comprising:

a cross conduit means operatively connecting the outlet of said air hydrant to the outlet of said water hydrant downstream of said at least one shut-off valve of said water hydrant, restriction means within said air hydrant downstream of said conduit connection therebetween for ensuring sufficient air pressure within said air hydrant to force air into the cross conduit and to blow out water accumulating in the water hose upon snowgun shut down, and check valve means within said cross conduit means between said hydrants for preventing flow of water into said air hose at any time and for permitting flow of compressed air through said water hose when said shut-off valve of said water hydrant is closed for blowing out accumulated water within said water hose in the direction of said snowgun.

2. The system as claimed in claim 1, wherein said check valve means comprises a check valve body connected to an end of said cross conduit means proximate to said water hydrant outlet.

3. The system as claimed in claim 1, wherein T-fittings are sealably interposed between said hydrant outlet and respective hoses, and said T-fittings each includes a right angle projection operatively coupled to respective ends of said cross conduit means and opening thereto.

4. The system as claimed in claim 2, wherein a T-fitting is interposed between each of said hydrant outlets and a respective hose, and said T-fittings each includes a right angle projection operatively connected to respective ends of said cross conduit means.

5. The system as claimed in claim 2, wherein said check valve body comprises an annular member having an axial bore and a counterbore, a lock ring proximate to the end of said check valve body bearing said counterbore and being closed off by a bottom wall, at least one radial port opening within the side of the check valve body at the counterbore, a valve disk interposed between said check valve body and said bottom wall of said lock ring and having a diameter in excess of the diameter of said axial bore within said check valve body but less than the diameter of said counterbore, and said check valve means further including a coil spring interposed between a bottom wall of said lock ring and a face of said valve disk remote from said axial bore, said valve spring having a spring constant and being sized such that the biasing force of said coil spring is less than the force exerted on the valve disk by the compressed air acting through said cross connect conduit means such that normally, water under pressure passing from said water manifold pipe to said water hose acts in conjunction with said coil spring to maintain said check valve disk seated to prevent communication between said check valve body bore and counterbore while, with the water hydrant shut-off valve closed, the air pressure within said air hydrant is sufficient to open the check valve to cause compressed air purging of water within the water hose in the direction of the snowgun.

6. The system as claimed in claim 1, wherein a three-way ball-type valve is interposed between said air hydrant and said air hose, said three-way valve comprising a valve body having a spherical interior cavity, a rotatable valve member positioned within said cavity, said valve body further including diametrically opposed inlet and outlet ports and a blow-out port positioned intermediate of said diametrically opposed inlet and outlet ports, said rotatable ball valve member including a through bore for axial alignment with said inlet and outlet ports when in a first position and for rotating to a second position at right angles thereto for closing off at least said inlet port, said ball valve member including a flat face on the periphery of thereof for defining within said valve cavity said restriction means, spaced from said through bore and positioned such as to selectively communicate said air inlet port with said blow-out port, with said ball valve member in a third position, and wherein said conduit means connects at one end to said blow-out port of said three-way ball-type valve body and at the opposite end thereof to said water hose proximate to said water hydrant shut-off valve and downstream thereof, and said system further includes means for selectively rotating said rotatable ball valve member between said first, second and third positions to cause compressed air from said source to escape through said three-way valve in said blow-out hose for completely blowing out of the water hose in the direction of said snowgun, while allowing the snowgun to be completely blocked off during the blow-out period or partially blocked off to allow some airflow to prevent water at the snowgun from bleeding into the air hose.

7. In a snowmaking system comprising:

a snowmaking machine, a first hose for carrying compressed air under pressure and being adapted to be coupled at one end to a source of compressed air, a water manifold pipe for carrying water under pressure and being adapted to be coupled at one end to a source of water under pressure, a shut-off valve opening to an air hose outlet connected to said air hose remote from said source of compressed air, at least one water hydrant connected to said water manifold pipe remote from said source of water and including a first shut-off valve opening to a hydrant outlet, a water hose coupled at one end to said hydrant outlet and having a second end adapted to be connected via a second shut-off valve to a water inlet of said snowmaking machine, the improvement wherein:

a first three-way ball-type valve is coupled between an inlet end of said water hose and said water hydrant, a second three-way ball-type valve is coupled to the outlet end of said water hose and between the outlet end of the water hose and said water inlet to said snowmaking machine, each three-way ball-type valve including a valve body having an internal spherical valve body cavity, first and second diametrically opposite inlet and outlet ports within said valve body opening to said cavity, a blow-out port within said valve body intermediate of said inlet and outlet ports and opening to the valve cavity, a rotatable valve member mounted within said spherical valve body cavity and including a through bore for axial alignment with said inlet and outlet ports for selective axial alignment with said inlet and outlet ports in a first position and for rotation to a second position at right angles thereto for closing off at least said inlet port, and said ball valve member including a flat face within the periphery thereof spaced from said through bore and carried thereby so as to form with said valve cavity, when said ball valve member is in a third position, a limited fluid connection between said inlet port and said blow-out port, and means for controlling rotation of said rotatable ball valve member between said first, second and third positions, such that with both three-way ball-type valves having rotatable valve members thereof at said first position, water flows freely from said water manifold pipe to said snow machine, and with said rotatable ball valve members rotated to said third position within each of said three-way ball valves, respectively, compressed air under high pressure flows from said source through said three-way ball type valve proximate to said snowmaking machine at the end of the water hose remote from said water manifold pipe to blow out the water completely through the water hose, while permitting water to escape through the three-way ball-type valve proximate to said water hydrant at said blow-out port.

* * * * *